US006564773B2

(12) United States Patent
Mori et al.

(10) Patent No.: US 6,564,773 B2
(45) Date of Patent: May 20, 2003

(54) MULTI-VALVE ENGINE

(75) Inventors: Akiyoshi Mori, Fujisawa (JP); Haruki Kobayashi, Fujisawa (JP)

(73) Assignee: Fuji Oozx Inc., Kanagawa (JP)

( * ) Notice: Subject to any disclaimer, the term of this patent is extended or adjusted under 35 U.S.C. 154(b) by 0 days.

(21) Appl. No.: 10/165,357

(22) Filed: Jun. 6, 2002

(65) Prior Publication Data

US 2003/0051704 A1 Mar. 20, 2003

(30) Foreign Application Priority Data

Sep. 14, 2001 (JP) ..... 2001-279043

(51) Int. Cl.[7] ..... F01L 3/02

(52) U.S. Cl. ..... 123/321; 123/315; 123/432; 123/188.3

(58) Field of Search ..... 123/308, 432, 123/188.3, 315, 321, 90.19

(56) References Cited

U.S. PATENT DOCUMENTS 4,834,036 A * 5/1989 Nishiyama et al. ..... 123/188.3
4,872,431 A * 10/1989 Akao et al. ..... 123/188.3
5,094,200 A * 3/1992 Fontichiaro ..... 123/188.3
5,458,314 A * 10/1995 Bonesteel ..... 123/188.3
5,586,530 A * 12/1996 Adachi et al. ..... 123/188.3

* cited by examiner

*Primary Examiner*—Erick Solis
(74) *Attorney, Agent, or Firm*—Hendricks, Slavin & Holmes LLP

(57) ABSTRACT

A multi-valve engine comprises a plurality of intake and exhaust valves on a cylinder. Depending on use, one of the valves is made of higher heat-resistant material, and another is made of lower heat-resistant material, thereby decreasing cost and improving durability and reliability.

6 Claims, 3 Drawing Sheets

MULTI-VALVE ENGINE

BACKGROUND OF THE INVENTION

The present invention relates to a multi-valve engine on which a plurality of intake or exhaust valves are mounted to a cylinder.

In such a multi-valve gasoline engine, DOHC-type valve-operating mechanism, two intake and exhaust valves are usually mounted on a cylinder.

The intake and exhaust valves used in such a multi-valve are made of the same material for an intake or exhaust valve depending on form and specification of the engine.

Recently, owing to intensification in regulation of a toxic exhaust gas and reduction in discharge amount of $CO_2$, intake and exhaust conditions of a gasoline engine are inclined to vary widely. Various measures and changes in specifications are carried out. For example, to reduce NOx, a lot of EGR (exhaust gas recirculation) is carried out, or to increase fuel efficiency, swirling flow is formed in a conduit, or changing a phase of a camshaft. For example, internal EGR is conducted to reduce pumping loss to increase engine performance. The measures may especially affect an intake valve. To reduce NOx, a lot of EGR is made, and a high temperature gas passes through part or all of multi-valve provided intake valve to reflux into a cylinder to raise temperature of the intake valve.

To form a swirling flow in conduits, there is a method of stopping part of a multi-valve intake valve, but new air does not pass through a stopped intake valve, thereby decreasing cooling capability under the valve head to raise temperature.

Furthermore, to control new intake amount, internal EGR is carried out while multi-valve-type intake valve is partially stopped to raise temperature of stopped intake valve.

Measures for reducing toxic exhaust gas and increasing fuel efficiency increase thermal load of an intake valve to reduce heat resistance and accelerating wear. It becomes unreasonable in cost, reliability and engine performance to make a plurality of intake valves from the same material, since one intake valve becomes excessive quality to decrease durability.

In a multi-valve diesel engine, a plurality of intake valves are made of the same material, and a plurality of exhaust valves are made of the same material. In a diesel engine in which one exhaust valve is a little opened to actuate an exhaust brake, it involves disadvantages to make the valves of the same material.

SUMMARY OF THE INVENTION

In view of the foregoing disadvantages, it is an object of the present invention to provide a multi-valve engine which decreases its cost to increase durability, reliability and engine performance by determining material of a plurality of intake and exhaust valves respectively depending on intake and exhaust conditions and use of valve.

BRIEF DESCRIPTION OF THE DRAWINGS

These and other features and advantages will become more apparent from the following description with respect to embodiments as shown in the appended drawings wherein.

DETAILED DESRIPTION OF PREFERRED EMBODIMENTS

Embodiments of the present invention will be described with respect to appended drawings.

Figure 1:
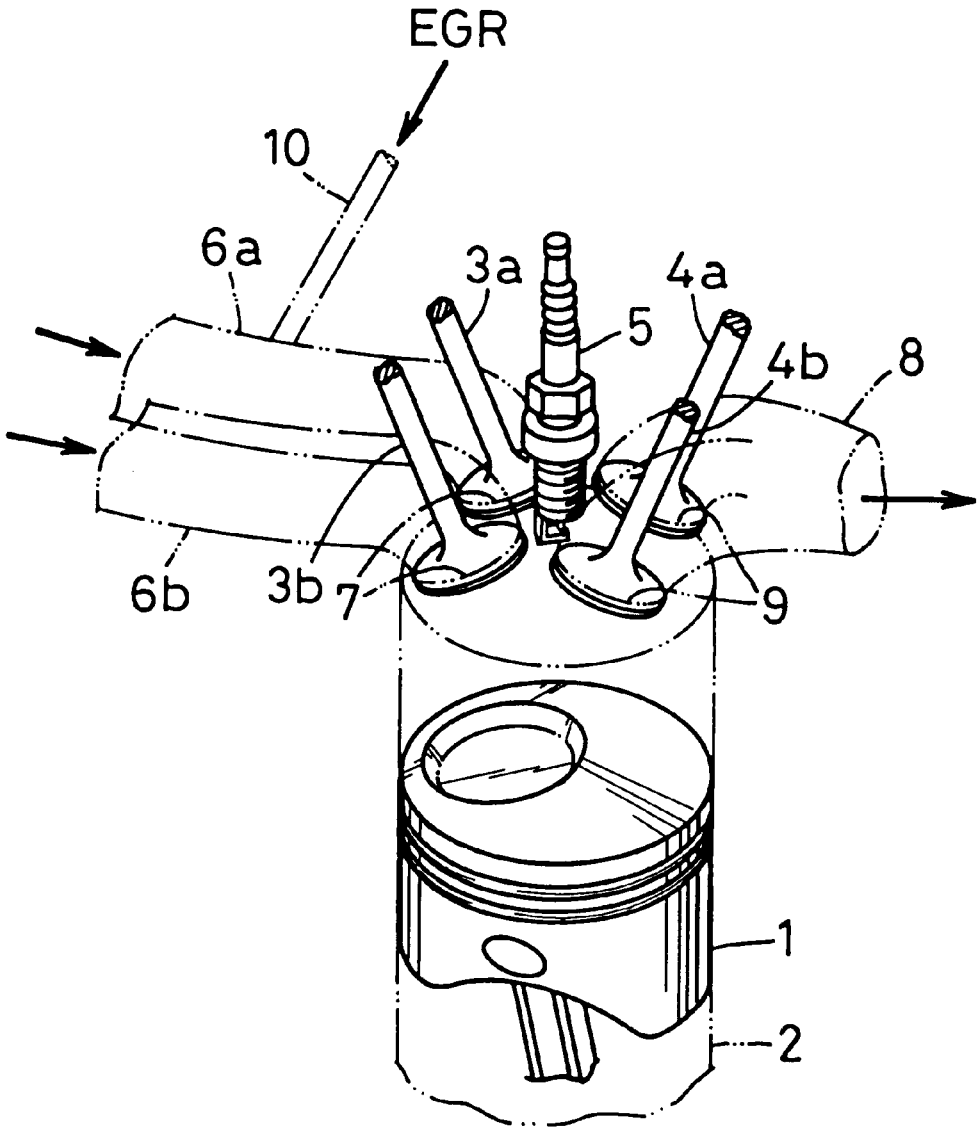
FIG. 1 is a schematic perspective view of the first embodiment of a multi-valve gasoline engine according to the present invention.

FIG. 1 illustrates the first embodiment of the present invention, which comprises part of a multi-valve internal combustion engine (a single cylinder) which has a DOHC-type valve-operating mechanism. Numeral 1 denotes a piston which moves up and down in a cylinder 2; 3*a*,3*b* denote two intake valves mounted to a cylinder head (not shown) by a valve spring and a valve spring retainer (not shown); 4*a*,4*b* denote two exhaust valves; and 5 denotes an ignition plug mounted to direct towards a center of the cylinder 2 in the cylinder head.

The intake valves 3*a*,3*b* opens and closes an inlet 7 by turning one of camshafts (not shown). The inlet 7 opens at the upper end of the cylinder 2 towards each of intake ports 6*a*,6*b*. Similarly, each of exhaust valves 4*a*, 4*b* opens and closes an outlet 9 of a branched exhaust port 8 by the other camshaft.

To the intake port 6*a*, an exhaust valve reflux pipe 10 connected to an exhaust manifold (not shown) is connected so that part of an exhaust gas may be controlled and refluxed by an EGR control valve (not shown) during high speed and high load operation. Thus, the intake valve 3*a* of the intake port 6*a* provides higher operation temperature and higher thermal load than the other intake valve 3*b*.

The intake valve 3*a* is made of higher heat resistant material, for example, martensitic heat-resistant steels such as SUH3 and SUH5 widely used as an ordinary intake valve and Cr steel such as 5Cr steel. The other intake valve 3*b* that has lower thermal load is made of lower heat resistant and less expensive material, for example carbon steel, general structural steel and light materials, for example Al alloys such as Al—Si and Al—Si—Cu and Ti alloys such as Ti64.

One 3*b* of the two intake valves that is made of inexpensive material reduces inertial mass of a valve-operating mechanism and mechanical loss such as friction, thereby increasing engine performance such as output and fuel rate. The exhaust valves 4*a*,4*b* are made of austenitic heat-resistant steel such as SUH35 or SUH36.

Figure 2:
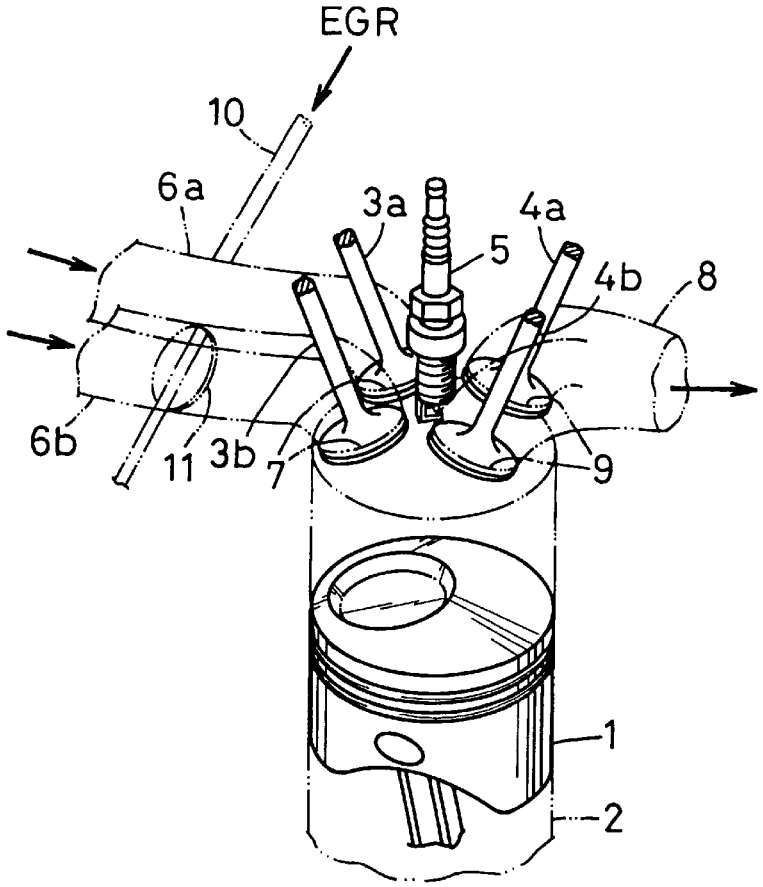
FIG. 2 is a schematic perspective view of the second embodiment of a multi-valve gasoline engine according to the present invention.

FIG. 2 illustrates the second embodiment of the present invention, in which a swirl control valve 11 is provided in an intake port 6*b*. By the control valve 11, an intake valve 3*b* is stopped during low and middle speed rotation, and an inlet 7 of an intake port 6*a* is closed, thereby forming swirl flow in a cylinder 2 to increase combustion rate.

In a multi-valve engine of this embodiment, the intake valve 3*b* which stores the swirl control valve 11 is always operated, and new air is brought repeatedly a cycle to increase cooling effect and to decrease thermal load. Similar to the above, lower heat resistance materials such as carbon steel, general structural steel, Al alloy or Ti alloy can be used.

In the intake valve 3*a* which stops during formation of swirl flow, cooling effect by new air is hindered, and owing to reflux of the exhaust gas, operation temperature rises to increase thermal load.

Thus, as material of the intake valve 3*a*, similar to the above, martensitic heat-resistant steel or higher heat-resistant austenitic steel may be employed.

The intake valve 3*a* provides decreased operation number compared with the other intake valve 3*b* to provide relatively low friction, and the material can be used. In the other intake valve 3*b* which is always operated, wear resistance treatment may be applied. For example, hard alloy such as stellite is padded on the valve face, or tufftriding may be applied to harden the whole valve.

To decrease thermal load of the intake valve 3*a*, relatively high heat-resistant and high heat-transferring materials such as Ti—Al intermetallic compounds and carbon steel are employed so that heat in a valve head may be escaped to a cylinder head via a valve seat and a valve guide, thereby increasing cooling effect.

Figure 3:
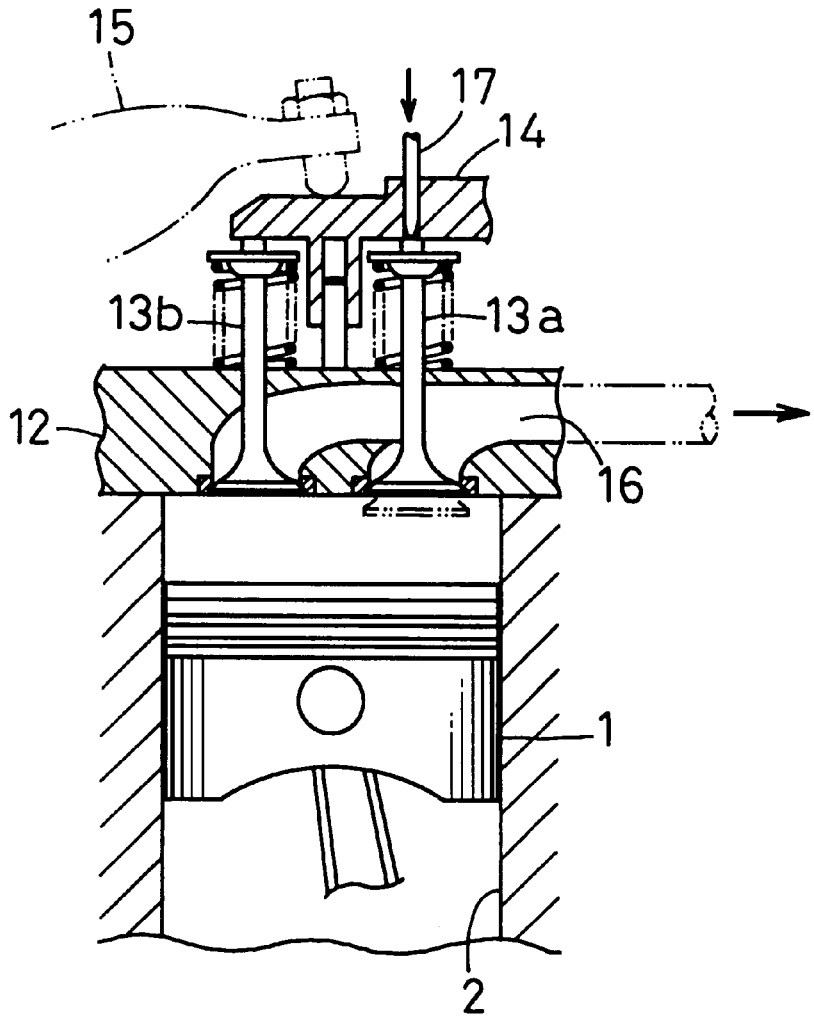
FIG. 3 is a vertical front view of the third embodiment of a multi-valve gasoline engine according to the present invention.

FIG. 3 illustrates the third embodiment in which part of muti-valve and multi-cylinder diesel engine is drawn. In a cylinder head 12, two intake valves (not shown) and two exhaust valves 13*a*,13*b* are mounted to each cylinder 2.

In exhaust valves 13*a*,13*b*, the middle of the upper surface of a T-shaped pressing member 14 is pressed by the end of a rocker arm 15 which is moved up and down by a cam of a cam shaft (not shown), so that the valves 13*a*,13*b* are operated at the same time to open and close a forked exhaust port 16.

Each of the intake valves is operated by a mechanism similar to the above to open and close an intake port (not shown).

In a multi-valve multi-cylinder diesel engine, there is an exhaust braking system in which an exhaust brake is operated to increase braking force by closing an exhaust shutter of an exhaust pipe (not shown).

In the exhaust braking system, one of the exhaust valve 13*a* is a little opened by a compression rod 17 of an actuator thereon, and an exhaust gas in an exhaust manifold is filled into a combustion chamber of the cylinder 2, to increase compression loss to increase braking force.

In a diesel engine which has such an exhaust braking system, high temperature exhaust gas passes through the exhaust valve 13*a*. Thus, the valve 13*a* becomes higher in temperature than the other exhaust valve 13*b* to increase thermal load.

Therefore, the exhaust valve 13*a* is made of heat- and wear-resistant materials comprising Ni heat-resistant superalloy such as NCF751 and NCF80A. Alternatively, the whole valve is made of austenitic heat-resistant steel such as SUH36 or SUH36, and a valve face is padded by Co hard metals (stellite), or Co or Ni intermetallic compounds (triballoy).

The other exhaust valve 13*b* is made of ordinary austenitic heat-resistant steel or Ti alloys such as Ti6242, or stellite is padded on a valve face.

The exhaust valve 13*b* that is subject to high thermal load is made of heat-resistant material and hard material is padded on the valve face that requires wear resistance, thereby increasing durability significantly to increase reliability of an engine.

The present invention is not limited to the foregoing embodiments. In the first and second embodiments, what requires heat resistance is mainly a valve head of the intake valve 3*a*, and the whole valve need not be made of higher heat resistance, but may be made of a welding-type intake valve 3*a* in which a valve stem made of low specific gravity material is bound with a valve head made of high heat resistance.

In the embodiment as shown in FIG. 3, only the valve head of the exhaust valve 13*a* requires heat resistance and wear resistance. The valve head is made of higher heat- and wear-resistant material, and the valve stem is made of relative low heat- and wear-resistant material, higher thermal conductive material or lower specific gravity material. The valve head is then combined with the valve stem.

Therefore, cooling capability of the exhaust valve 13*a* is increased and the valve 13*a* can be lightened.

Other than the foregoing multi-valve gasoline engine, the present invention is applied to a multi-valve gasoline engine which comprises EGR and a swirl control valve, a multi-valve having an internal EGR.

The foregoing merely relates to embodiments of the invention. Various changes and modifications may be made by persons skilled in the art without departing from the scope of claims wherein:

What is claimed is:

1. A multi-valve engine which has a plurality of intake and exhaust valves on a cylinder, one valve being made of material different from that of another valve depending on use wherein one intake valve is made of higher heat-resistant material, the other being made of lower heat-resistant material.

2. A multi-valve engine as claimed in claim 1 wherein the higher heat-resistant material is one of martensitic heat-resistant steel and Cr steel, while the lower heat-resistant material is one of carbon steel, general structural steel, Al alloy and Ti alloy.

3. A multi-valve engine which has a plurality of intake and exhaust valves on a cylinder, one valve being made of material different from that of another valve depending on use wherein one of the intake valves has a swirl control valve and is made of lower heat-resistant material, the other intake valve being made of higher heat-resistant material.

4. A multi-valve engine as claimed in claim 3 wherein the higher heat-resistant material is one of martensitic and austenitic heat-resistant steel, the lower heat-resistant steel being one of carbon steel, general structural steel, Al alloy and Ti alloy.

5. A multi-valve engine which has a plurality of intake and exhaust valves on a cylinder, one valve being made of material different from that of another valve depending on use wherein the engine comprises a diesel engine having an exhaust braking system, one of the exhaust valves comprising higher heat-resistant material, the other of the exhaust valves being made of lower heat-resistant material.

6. A multi-valve engine as claimed in claim 5 wherein the higher heat-resistant material is made of one of Ni super-heat-resistant alloy, austenitic heat-resistant steel, Co super hard alloy and Co/Ni intermetalic compound being padded on a valve face, the other of the exhaust valves being made of one of heat-resistant steel and Ti alloy.

* * * * *